US009220132B2

(12) United States Patent
Marcotte

(10) Patent No.: US 9,220,132 B2
(45) Date of Patent: Dec. 22, 2015

(54) BREAKOVER CONDUCTION ILLUMINATION DEVICES AND OPERATING METHOD

(71) Applicant: Robert G. Marcotte, New Paltz, NY (US)

(72) Inventor: Robert G. Marcotte, New Paltz, NY (US)

( * ) Notice: Subject to any disclaimer, the term of this patent is extended or adjusted under 35 U.S.C. 154(b) by 0 days.

(21) Appl. No.: 14/311,278

(22) Filed: Jun. 21, 2014

(65) Prior Publication Data

US 2014/0375618 A1 Dec. 25, 2014

Related U.S. Application Data

(60) Provisional application No. 61/838,243, filed on Jun. 22, 2013.

(51) Int. Cl.

| | |
|---|---|
| ***H05B 33/08*** | (2006.01) |
| ***G09G 3/292*** | (2013.01) |
| ***G09G 3/296*** | (2013.01) |
| ***G09G 3/32*** | (2006.01) |
| ***G09G 3/293*** | (2013.01) |

(52) U.S. Cl.

CPC ..... *H05B 33/0803* (2013.01); *G09G 3/293* (2013.01); *G09G 3/2927* (2013.01); *G09G 3/2965* (2013.01); *G09G 3/3225* (2013.01); *G09G 2300/089* (2013.01); *G09G 2300/0885* (2013.01); *G09G 2310/0216* (2013.01)

(58) Field of Classification Search

CPC ..... H05B 33/0803; H05B 33/0896; G09G 3/2927; G09G 3/2965; G09G 3/293; G09G 3/3225; G09G 3200/089; G09G 2300/0885

USPC ..... 345/205, 207, 214, 215, 82; 348/800–803, 797

See application file for complete search history.

(56) References Cited

U.S. PATENT DOCUMENTS

| | | | | |
|---|---|---|---|---|
| 3,522,473 | A | 8/1970 | Babb | |
| 3,638,203 | A | 1/1972 | Patel | |
| 3,883,887 | A * | 5/1975 | Robinson, Sr. | 345/80 |
| 5,317,334 | A | 5/1994 | Sano | |
| 5,514,882 | A | 5/1996 | Shulman | |
| 6,630,916 | B1 | 10/2003 | Shinoda | |
| 6,850,213 | B2 | 2/2005 | Marcotte | |
| 7,109,956 | B2 * | 9/2006 | Fery et al. | 345/77 |
| 8,493,773 | B2 * | 7/2013 | Marcotte | 365/149 |
| 2007/0152913 | A1 * | 7/2007 | Yan et al. | 345/67 |
| 2007/0215854 | A1 * | 9/2007 | Chou et al. | 257/13 |
| 2009/0167202 | A1 | 7/2009 | Miskin et al. | |
| 2010/0207920 | A1 | 8/2010 | Chaji et al. | |
| 2013/0057176 | A1 * | 3/2013 | Marcotte | 315/252 |
| 2013/0121064 | A1 * | 5/2013 | Marcotte | 365/149 |
| 2013/0162690 | A1 * | 6/2013 | Marcotte | 345/690 |
| 2013/0285569 | A1 * | 10/2013 | Marcotte | 315/224 |

FOREIGN PATENT DOCUMENTS

CN 101763810 A * 6/2010

* cited by examiner

*Primary Examiner* — John Villecco

(57) ABSTRACT

The invention contained herein provides solid-state breakover conduction illumination devices, displays and driving methods. Illumination devices may be fabricated as co-packaged devices or integrated devices using in-organic or organic illumination elements. AC breakover conduction displays are embodied in both small, tightly-integrated configurations as well as, large area discrete implementations. Driving methods employ initialization and resetting methods for subfield based operation; taking advantage of the stable high speed characteristics of solid-state breakover devices such as DIACs. A full-color high-resolution DIAC based display is presented.

22 Claims, 7 Drawing Sheets

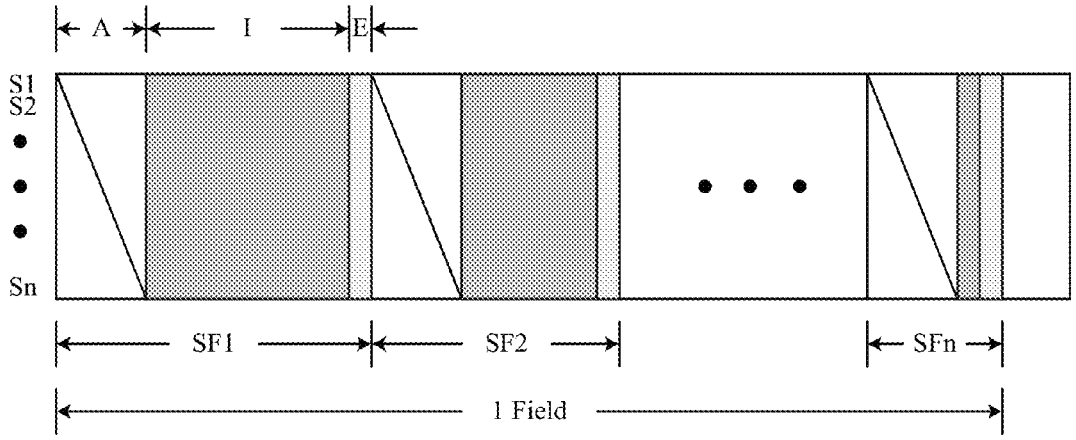
FIG. 1 Prior Art
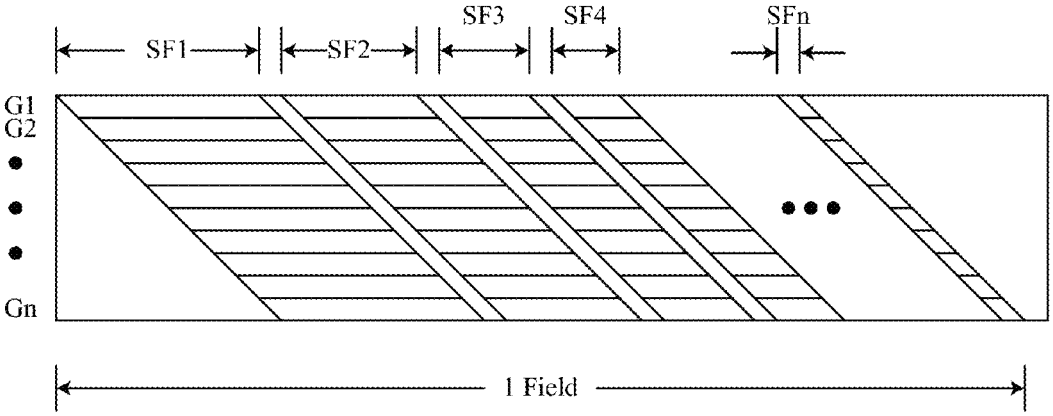
FIG. 2 Prior Art
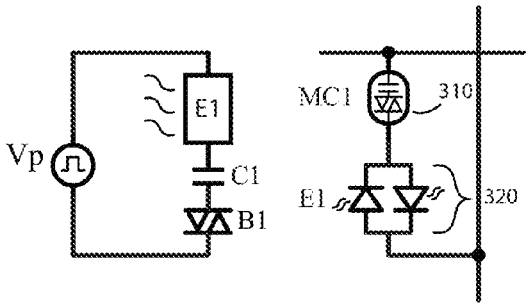
FIG. 3a FIG. 3b
FIG. 3 Prior Art

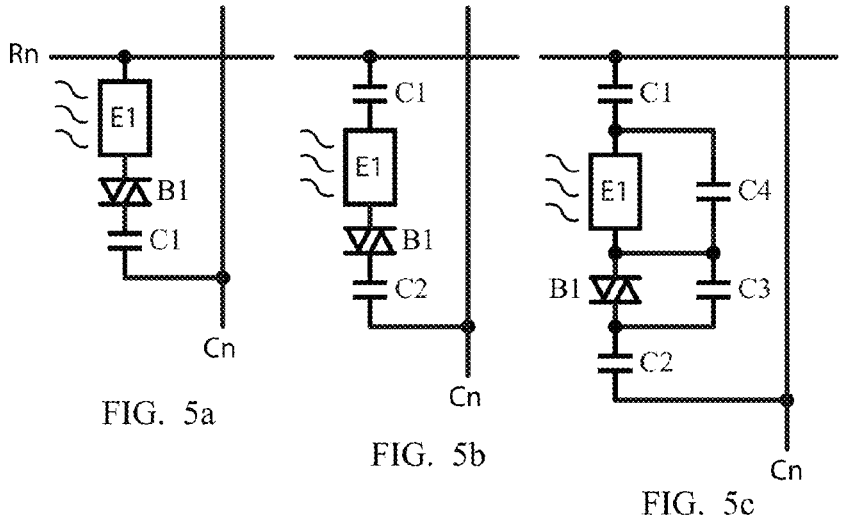
FIG. 5a
FIG. 5b
FIG. 5c
FIG. 5
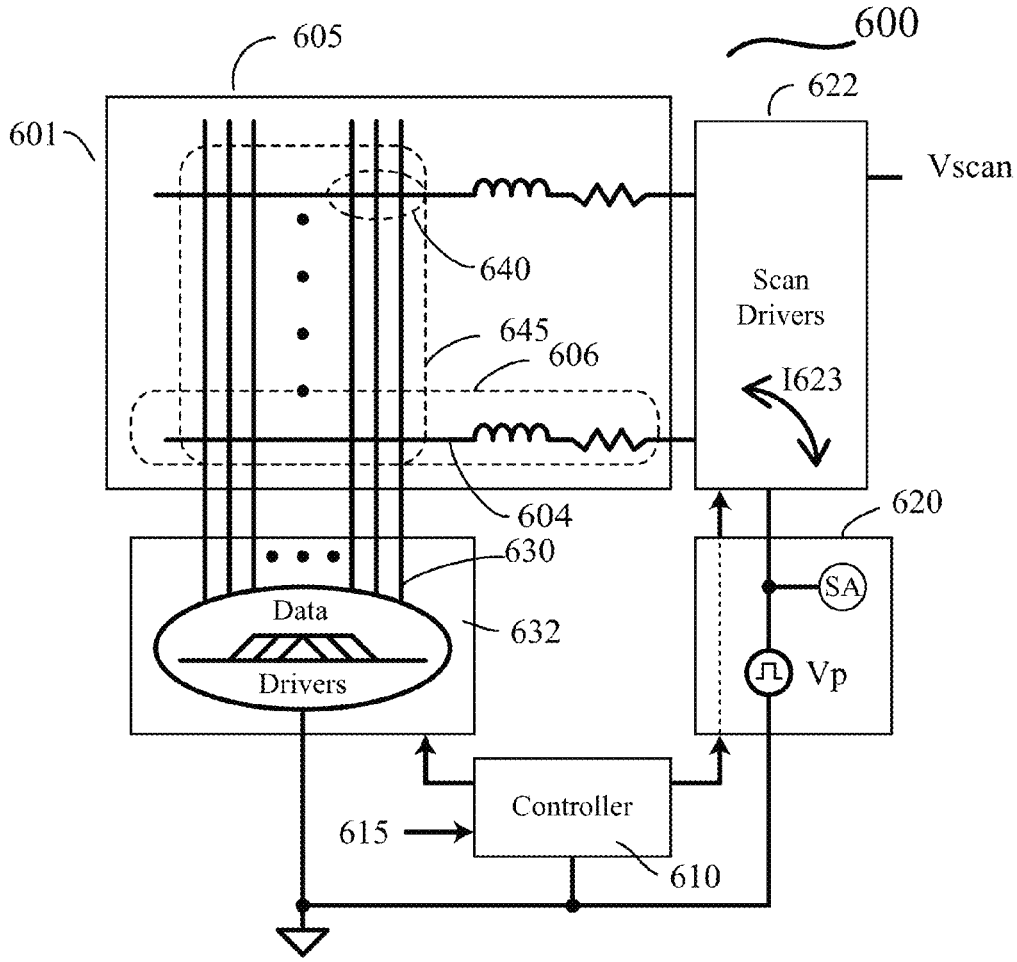
FIG. 6

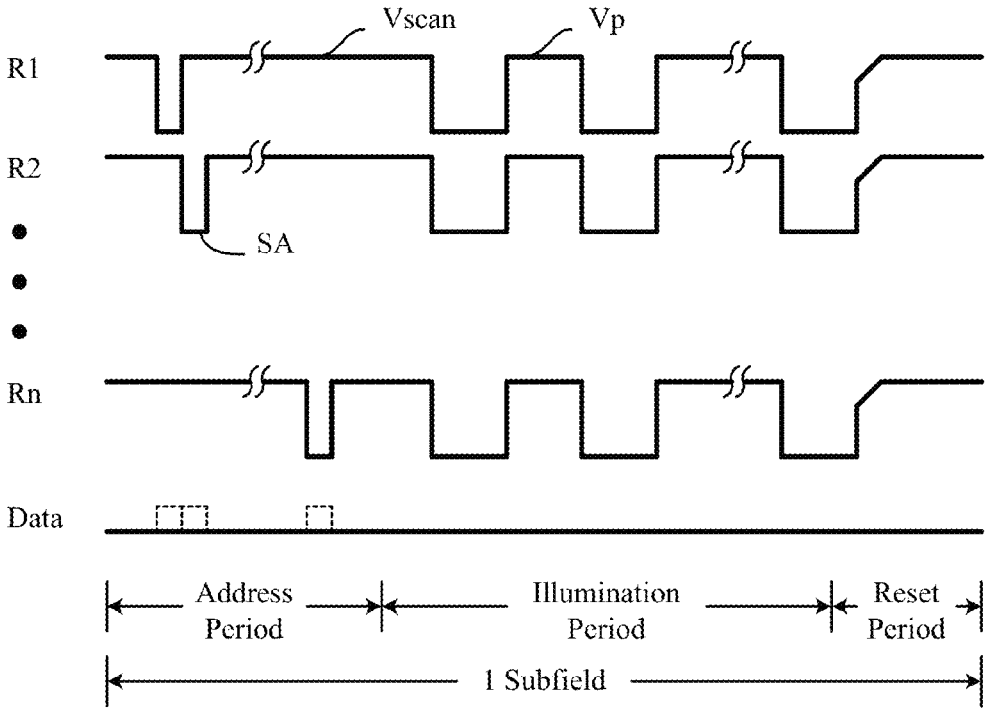
FIG. 7
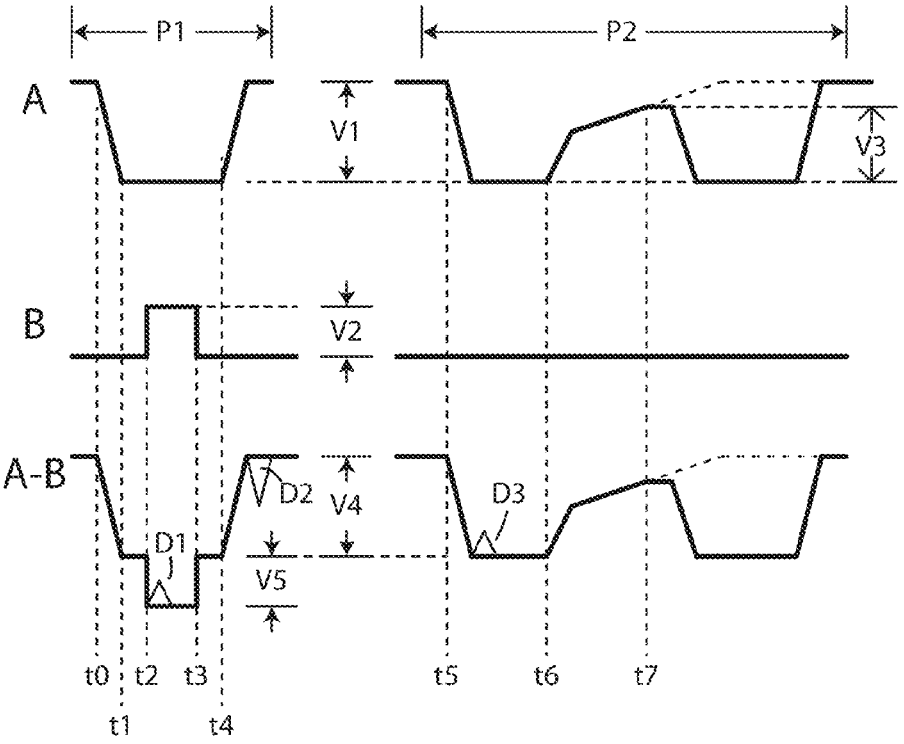
FIG. 8a FIG. 8b
FIG. 8

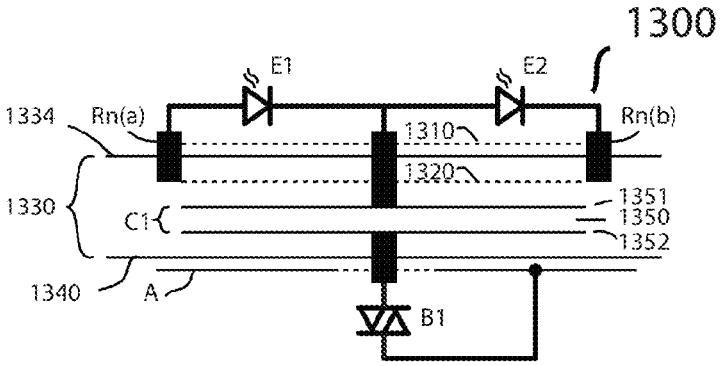
FIG. 13
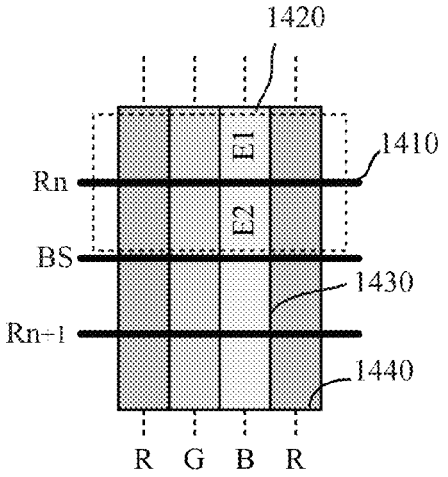
FIG. 14
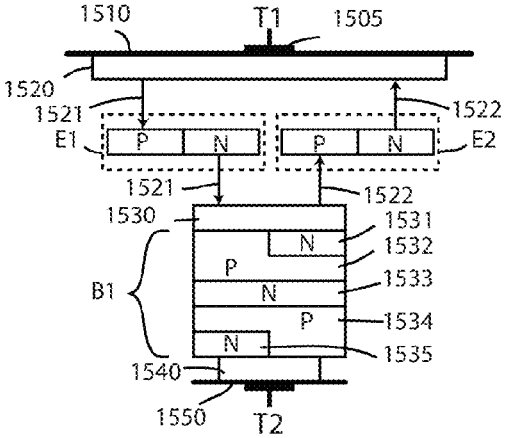
FIG. 15a
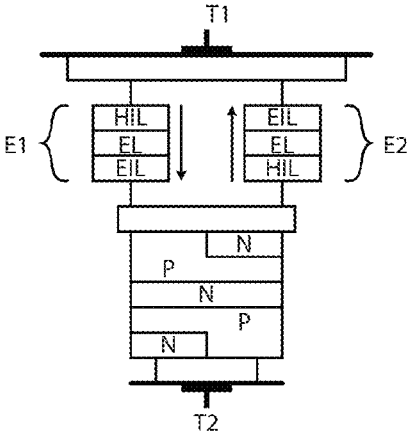
FIG. 15b
FIG. 15

BREAKOVER CONDUCTION ILLUMINATION DEVICES AND OPERATING METHOD

CROSS-REFERENCES

This application claims the priority of provisional application: 61/838,243 filed on Jun. 22, 2013 by inventor Robert G Marcotte entitled: "Breakover Conduction Illumination Devices and Operating Method".

BACKGROUND OF THE INVENTION

This patent relates to the field of solid-state AC-coupled breakover conduction devices and, in particular, to illumination and display devices utilizing the properties of AC-coupled breakover conduction. The invention provides structures and driving methods for DIAC based illumination devices and display cells. Embodiments are provided for small and large displays alike.

DESCRIPTION OF THE RELATED ART

Dielectric barrier gas discharge devices, such as AC plasma display panels (PDPs), comprise pluralities of electrodes disposed orthogonally on opposing substrates. The electrodes are coated with a dielectric material; forming capacitive dielectric barrier surfaces on each substrate. The dielectric barrier surface accumulates charge indicative of binary memory states (ON and OFF, or set and reset) and limits gas discharge power. The dielectric barrier capacitively couples the dischargeable gas to the electrodes. Display cells are defined at electrode crossing areas with a red, green and blue (RGB) pixel defined at the intersection of a row electrode and three column electrodes for red, green and blue subpixels respectively. Visible light generated within the volume of the display cell passes through the front substrate.

Dischargeable gasses are well known breakover conduction materials. Gaseous breakover conduction properties are altered according to surrounding surface materials. For example, the MgO layer in a PDP lowers the gas breakdown voltage and continues to emit electrons long after a discharge completes. As such, gaseous breakover voltages are variable and highly depend on temperature, MgO emission and recent discharge activity called priming.

When voltage is applied across the gas which is greater than the gas breakdown voltage, the dischargeable gas becomes precipitously conductive (henceforth referred to as a discharge) and the voltage there-across drops quickly. Current rises sharply according to the gas mixture's negative resistance characteristic until reaching a steady state low resistance characteristic. The discharge will continue indefinitely provided there is sufficient voltage applied and current available. Once the voltage is removed, the discharge terminates and excitation decays. In an AC-coupled gas discharge device, the breakover current flow charges a capacitance, positively or negatively, according to the prior voltage there-across and the current flow there-through. The discharge terminates and excitation decays when the surfaces are charged and the voltage across the gas falls to zero. As excitation levels decay, the impedance of the gas increases accordingly.

There are distinct differences between gaseous and solid-state breakover conduction discharges. A breakover conduction device is a bidirectional solid-state electronic switching device having stable and well defined characteristics. DIACs, thyristors, and the like, are operable at predetermined, and opposing, breakover voltages, operating currents and holding currents. Holding current is the turn-off current level. It is the minimum current required to maintain conductivity in a solid state breakover conduction device.

Breakover conduction devices are binary displays, having ON or OFF illumination states. A variety of binary display driving methods are employed in the art. Most notably are the Address Display Separated or ADS method and the Address While Display (AWD) method.

U.S. Pat. No. 6,630,916 to Shinoda, herein incorporated by reference, discloses an ADS driving method for providing brightness gradations where a display frame (i.e. a display image) is rendered over a plurality of sub-frames hence-forth referred to as subfields. FIG. 1 illustrates an implementation of the method. According to the figure, each subfield (SF1, SF2, . . . SFn) comprises an addressing time period A wherein every row of display cells is selected and memory cells are set according to display data respective to the desired ON/OFF state for each respective subfield. Furthermore, the method comprises illumination time periods I subsequent to each addressing time period A for providing illumination in displays cells according to the addressed state (ON or OFF). Only display cells set to the ON state are illuminated in the following illumination period. Each illumination period I contains a plurality of driving pulses. The number of driving pulses, and thus the width of the illumination time period are predetermined according to the subfield so that cumulatively, over the course of a frame time, the desired display image is rendered.

U.S. Pat. No. 5,317,334 to Sano, herein incorporated by reference, provides an AWD method wherein driving pulses are generated as a substantially continuous pulse train. FIG. 2 illustrates the method. As in the Shinoda method, subfields provide brightness gradations, however Sano teaches addressing groups of rows within the continuous driving pulse train. For an individual subfield, within the span of each driving pulse time period, a plurality of display rows are addressed such that illumination can occur over succeeding driving pulses. After the predetermined number of driving pulses respective to the subfield, display rows are reset (i.e. reset to the OFF state) in the order that they were written (i.e. set to the ON state).

U.S. Pat. No. 5,745,086 to Weber, herein incorporated by reference, takes advantage of partial conductivity from excited gas molecules and priming. Weber teaches using a positive resistance region at the gas breakdown voltage to maintain partial conductivity while altering the wall charge, without triggering a negative resistance discharge. The method relies on the presence of excitation within the dischargeable gas and surface materials; most notably, the MgO surface. Utilizing this method, gas discharge devices may be initialized prior to addressing periods using long slowly ramping pulses. U.S. Pat. No. 5,852,347 to Marcotte illustrates a driving method wherein ramping voltages initialize and erase display cells according to Weber '086 and is herein incorporated by reference. While plasma displays may utilize extended ramping waveforms to exploit a positive resistance region for initialization and resetting of wall charges, the minimum holding current characteristic of DIAC based illumination cells generally prohibits this method. Thus, an alternative initialization and resetting sequences are needed.

U.S. Pat. No. 8,493,773 to Marcotte (the inventor herein) is herein incorporated by reference. This patent application provides a solid-state memory-based illumination device utilizing breakover conduction for setting memory states in a memory cell. A prior art illumination cell shown in FIG. 3*a* illustrates a series arrangement comprising an illumination element E1, a capacitance C1, and a breakover conduction device B1 shown as a DIAC. Driving methods apply pulses to each memory cell to induce breakover conductivity for setting, reading, maintaining and erasing memory states. Illumination occurs as opposing breakover conduction currents flow through the illumination element E1. The terms breakover conduction current, discharge current and discharge are henceforth used synonymously. FIG. 3*b* illustrates a display cell of a matrix display comprising a memory cell portion 310 and an emissive portion 320. Each memory cell 310 comprises a capacitance and a breakover conduction device such as a DIAC. The emissive portion 320 is illustrated as an opposed parallel light emitting device pair in series with memory cell 310.

Breakover conduction devices such as DIACs, with small holding currents and a rapid turn-off characteristic demonstrate initialization problems. Thus methods are needed for operating methods optimized for these high speed devices. There is also a need for driving methods to realize a full color display utilizing breakover conduction illumination cells.

There is a need to integrate the components of a memory based illumination cell into structural configurations from discrete devices to integrated cell structures suitable for a display.

SUMMARY OF THE INVENTION

The invention contained herein provides embodiments for realizing large and small solid-state breakover conduction illumination devices. The invention provides discrete illumination devices, display cell structures formed between driving electrodes, a display device and driving methods. Embodiments detail both integrated (small pixel) configurations and discrete implementations for large displays. Embodiments herein may utilize any form of solid-state breakover conduction device. For the embodiments contained herein, DIAC structures are used to illustrate the features of the invention since the DIAC is a well characterized breakover conduction device.

In a first embodiment of the invention, operating methods are disclosed for operating the embodiments contained herein. In-particular, initialization and resetting waveforms utilize the sharp turn-on and turn-off characteristic of a DIAC to trigger resetting discharges while minimizing charge transfer when resetting a cell to the OFF memory state. For initialization, a higher voltage is applied than the primary operating voltage to extend the peak to peak range of the driving waveform. This initialization method precisely controls the reset, or OFF, memory state, wherein a low voltage addressing operation can readily trigger a discharge for setting the cell to the set, or ON, memory state while setting a display wide AC reference level.

A second embodiment of the invention comprises a printed circuit assembly, suitable for large-area discrete display implementations. The series arrangement of each component of a display cell allows latitude in the placement of the memory cell capacitance. In this embodiment, the opposed parallel pair of illumination elements are disposed on a front surface of a printed circuit, with the memory cell's DIAC and capacitance disposed on the back surface. In an alternative embodiment, the memory cell capacitance is disposed within the printed circuit. Each illumination element is coupled to first and second portions of a row electrode, enabling bidirectional current flows about the common connection between the illumination elements and the memory cell. Illumination elements may be formed as light emitting diodes (LEDs) or organic light emitting devices (OLEDs).

In a third and structural embodiment of the invention, an illumination device is an integrated structure of silicon based semiconductor devices, suitable for use as a discrete device or may be incorporated into a display structure. An integrated circuit display may be formed comprising rows and columns of illumination devices having red, green and blue color characteristics.

In a fourth embodiment of the invention, emissive portions comprise a layered structure of organic light emitting materials over a breakover conduction memory cell.

Additionally, the capacitance and/or breakover characteristics of red, green and blue structures may be optimized to achieve balanced color temperature; compensating for variations in red, green and blue output variations.

BRIEF DESCRIPTION OF THE FIGURES

FIG. 1 provides an illustration of the prior art ADS subfield driving method.

FIG. 2 provides an illustration of the prior art AWD subfield driving method FIG. 3 provides an illustration of a prior art embodiments of memory based display cells.

FIG. 5 provides schematic representation of alternative display cell series arrangements.

FIG. 6 provides a block diagram of a display device according to the invention.

FIG. 7 illustrates the driving method the invention and in-particular to an ADS subfield.

FIG. 8 illustrates expanded views of the setting and resetting operating methods.

FIG. 13 illustrates a second printed circuit embodiment wherein the memory cell capacitance is buried within a volumetric structure.

FIG. 14 is a second front (display side) view of a display utilizing structures according to the invention.

FIGS. 15*a* and 15*b* provide illumination device constructions utilizing light emitting diodes and organic light emitting materials, respectively.

DETAILED DESCRIPTION OF THE INVENTION

Figure 4:
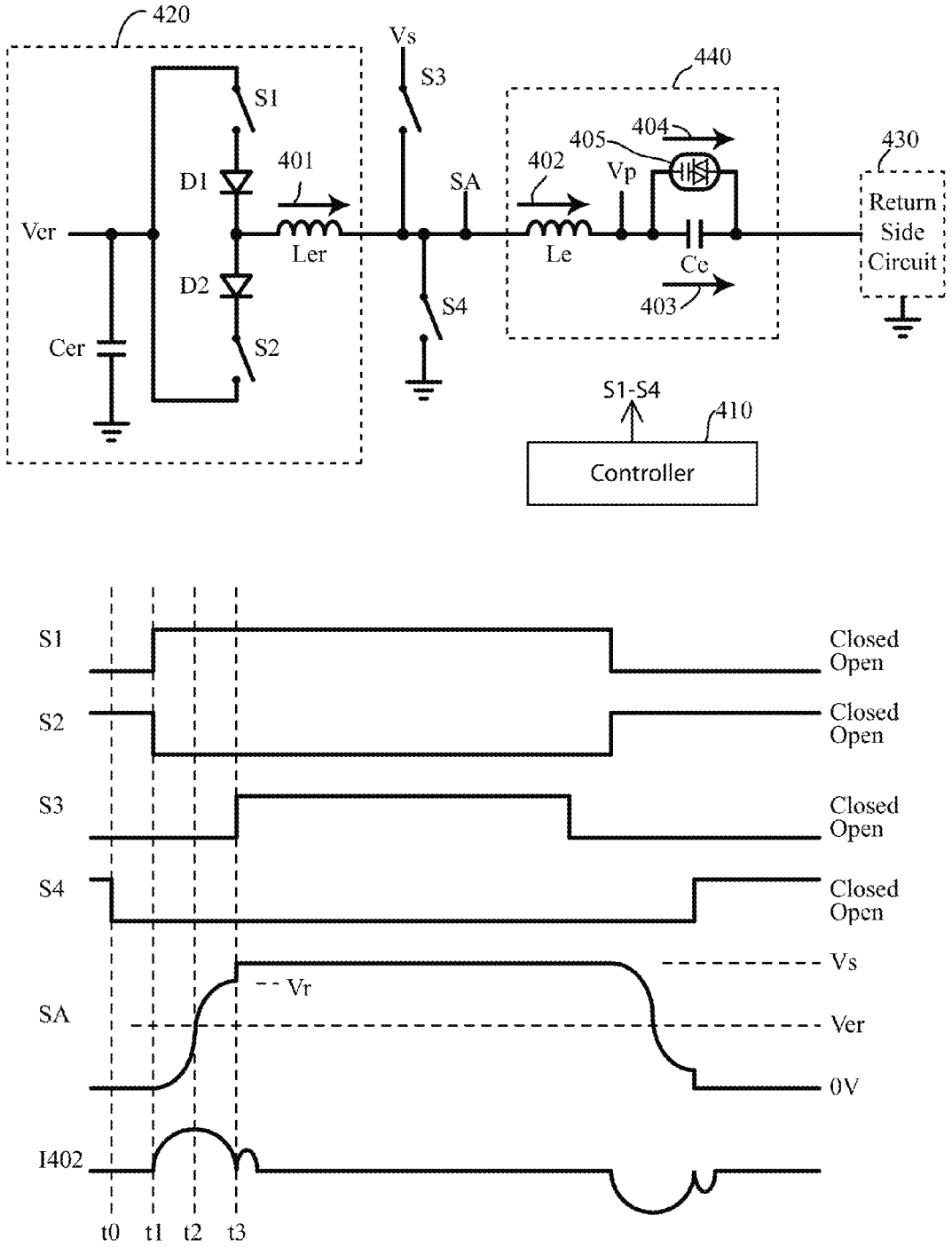
FIG. 4 Prior Art
FIG. 4 illustrates an energy recovery circuit for applying time varying driving pulses having symmetrical opposing slopes.

FIG. 5 illustrates alternative circuit arrangements for elements of an AC coupled breakover conduction display cell which may comprise discrete devices, co-packaged devices or integrated illumination devices. FIG. 5*a* depicts a row electrode Rn coupled to a series arrangement of a display cell. Row electrode Rn is coupled to a first terminal of illumination element E1. A second terminal of illumination element E1 is coupled to a first terminal of DIAC B1 and a second terminal of DIAC B1 is coupled to a first terminal of capacitance C1. The second terminal of capacitance C1 is coupled to a column electrode Cn. This is an alternate series configuration of prior art FIG. 3*a* wherein DIAC B1 and capacitor C1 are transposed.

FIG. 5*b* depicts a second configuration with two capacitances C1 and C2 coupled to row electrode Rn and column electrode Cn, respectively. As an alternative series arrangement, capacitances C1 and C2 form a capacitive divider suitable for withstanding higher voltages than implementations with a single capacitance while reducing the total capacitance.

FIG. 5*c* illustrates the capacitance C3 of DIAC B1 which is charged by application voltages. As DIAC B1 breaks over and transitions from the non-conductive state to the conductive state, voltage across capacitance C3 declines with the voltage across DIAC B1. Additional capacitance C3 may be disposed in parallel with DIAC B1 to adjust the breakover characteristic. FIG. 5*c* additionally illustrates a capacitance C4 across illumination element E1. This capacitance represents the forward voltage (capacitively) of illumination element E1.

FIG. 6 provides a display topology according to the invention. Display apparatus 600 comprises a display 605 comprising orthogonal pluralities of row electrodes 604 and column electrodes 630. Each row electrode is coupled to a respective scan driver 622 totem-pole output. Scan driver totem pole outputs are referenced by an output node SA of a pulse generator 620 and are supplied by a voltage Vscan. Pulse generator 620 provides time varying (i.e. sloped) pulses as described in reference to FIG. 4 for applying driving pulses during illumination time periods. Pulse generator 620, scan drivers 622 and data drivers 632 apply voltages for setting, resetting and initializing display cells 640 disposed at electrode crossing areas. Display cells 640, as illustrated, form a pixel comprising three column electrodes for red, green and blue display cells, respectively. A controller 610 receives a video signal or image data via input 615 and processes the information received for displaying the information according to a predetermined subfield driving method. After receiving a display image, controller 610 executes the subfield driving sequence to illuminate cells according to the display data representative of the display image.

FIG. 7 illustrates the operation of one of the plurality of subfields according to the ADS subfield driving method as previously described. That is, each display image or video frame is divided, with time, into a plurality of brightness weighted subfields. Rows electrodes R1, R2 . . . Rn and Data are illustrated with the signals applied thereto. Each subfield is divided, with time, into an address period, an illumination period, and a reset period. During each address period, scan drivers 622 output a positive voltage Vscan to de-select rows. Scan drivers 622 apply the reference voltage SA to select an individual row for addressing. Typically only one row is selected at a time and rows are selected sequentially from top to bottom.

FIG. 8*a* illustrates the setting operation. Time portion P1 illustrates the application of a row select pulse A to a row electrode and a data pulse B to a column electrode and the resulting applied voltage A-B across the display cell. At times t0-t1, the row select voltage V1, i.e. reference voltage SA, is applied having slope. The capacitively-coupled breakover conduction device, receives a voltage V4 there-across as a result of applying voltage V1. Due to the division of capacitances, shown in FIG. 5, in combination with a reset or OFF memory state, voltage V4 is typically less than voltage V1 and less than, but sufficiently close to, the breakover voltage of the breakover conduction device. Consequently, at time t2, the application of the data pulse voltage V2, provides an additional voltage V5 across the breakover conduction device for triggering a setting discharge D1. As each pulse is removed at times t3 and t4, a second discharge D2 is induced. Discharge D2 is typically greater than discharge D1 due to capacitive charging within the display cell from discharge D1 and the application of voltages V5 and V4. Once a charge is set in the display cell, the display cell capacitance stores the ON state for the remainder of the address period and into the illumination period.

Each illumination period contains a plurality of driving pulses according to the brightness weight of the subfield. The driving pulses are of a time varying form. Energy recovery methods such as shown in FIG. 4 may be employed for large area displays wherein large electrode capacitances must be driven.

As shown in FIG. 4, a resonant driving circuit produces a sloped, time-varying output waveform SA to drive electrodes of display 440. Driving signals S1-S4 operate switches S1-S4 respectively of resonant driving circuit 420 to produce output waveform SA under a zero load condition. Under this condition, resonant current pulse 401 flows through resonant inductor Ler, through the coupling capacitance Ce of display 440 and is returned through the opposing circuit 430. Circuit 430 is held to a constant potential during the operation shown. The value of inductance Ler is chosen to limit the rise time of output SA between times t1-t3 and determines the amplitude of current pulse 402. During operation, S1 closes at time t1 to apply voltage Ver to inductance Ler and current I401 (and therefore I402) begins increasing. At time t2, the voltage of output SA equals voltage Ver and current I401 (and therefore I402) peaks at this moment. Between times t2-t3 the voltage of output SA increases to voltage Vr as the current flow diminishes, reaching zero at time t3. At time t3, a small reverse current (not shown) is induced by the output voltage SA being greater than voltage Ver. This reverse current is momentary and limited as diode D1 becomes reversed biased. Also at time t3, switch S3 is closed to apply the voltage Vs to output SA, producing the small current pulse subsequent to time t3 shown on waveform I402 thus completing the resonant charging phase. Without any pixels being illuminated, there is no conductive phase following the application of supply voltage Vs. As the number of illuminated pixels increases, switches S3 and S4 conduct opposing discharge currents. U.S. patent application Ser. No. 13/338,189, herein incorporated by reference, and Ser. No. 13/218,742, herein incorporated by reference, to Marcotte provide additional energy recovery driving methods and electrode configurations respectively that may be employed.

The slope of driving pulses applied has importance. DIACs and other breakover conduction devices can falsely trigger from fast voltage transitions. If voltage transitions are too slow, the breakover conduction device can reach its breakover conduction voltage, discharge, and turn off sharply before the transition completes. Note that while the breakover conduction device is conducting, the current there-through must be greater than the holding current characteristic to remain conductive. As the cell current is proportional to the charging of the cell capacitance, the applied voltage slope must provide a charging current greater than the holding current to maintain the conductive state for completely charging the capacitance.

Referring again to FIG. 4, the slope of the output voltage SA between times t1-t3, must be slow enough to prevent false discharging, while maximizing energy recovery. The turn-on of switch S3 at time t3, sharply raising the output voltage from potential Vr to supply voltage Vs aids in triggering the illumination discharge such that the discharge completes as the output voltage SA reaches the supply voltage Vs. As a symmetrical device, the operation on the opposing (i.e. falling) slope of output SA is substantially the same; as shown.

Lastly, referring to FIG. 7, a reset period applies a reset pulse which takes advantage of the sharp turnoff characteristic to remove the charge indicative of the ON memory state. The operation will be discussed in reference to FIG. 8*b*.

The second time portion P2 of FIG. 8*b*, illustrates a final discharge D3 of an illumination period subsequent to the application of voltage V1. While it is preferable for voltage V1 of time period P2 to equal voltage V1 of time period P1, the equality is not expressly required. At times t6-t7, a reset pulse is applied having first and second slopes. The steeper first slope applies a voltage less than the breakover conduction voltage; the shallow second slope allows the breakover conduction to occur at each cell's individual breakover voltage to clear the memory state. As noted previously, the current induced by the shallow second slope must be below the breakover conduction device's holding current to properly reset the cell. It is a sharp turn-on, turn-off breakover characteristic that enables this method. Thus, in a reset discharge there is insufficient charge transfer for the cell to maintain the set or ON memory state. The reset pulse may complete at time T6, at voltage V3 and less than the voltage V1, where-at all set cells have been reset, or the pulse may continue to the rise to the full voltage V1. The voltage difference between voltage V3 and voltage V1 is illustrative of the margin between reset and set memory states.

Figure 9:
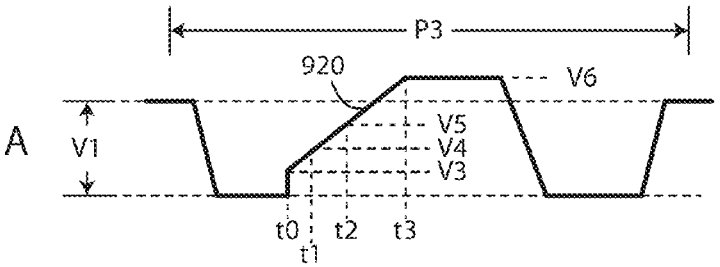
FIG. 9 illustrates an expanded view of a waveform for resetting and initializing display cells.

FIG. 9 illustrates a time period P3 for performing an initialize sequence or a reset and initialize sequence. Periodic initialization prevents AC-coupled cells from entering unstable memory states in cells that have been reset, or OFF, for a long period of time. The initialization pulse begins at a time t0, rising to a minimum resetting voltage V3, wherein a rising slope 920, has a slope incapable of maintaining a breakover conduction current. Note that this slope depends on the cell capacitance and the holding current characteristic of the breakover conduction device. The initialization pulse transitions through the resetting range V4 to V5, resetting any previously set or ON cells. Preferably, the initialization pulse rises to a voltage greater than the driving pulse voltage V1 to a voltage V6. During initial display turn on, voltage V6 is sufficient to trigger breakover conduction for setting an initial voltage across the display cell capacitance. Subsequently, under normal operation, voltage V6 provides waveform A with a peak-to-peak voltage sufficient to form an AC reference level within the AC coupled display cell such that stable operation occurs with negligible background glow. In a large area AC display device, it is advantageous to have a common reference level for all cells for stable operation.

Figure 10:
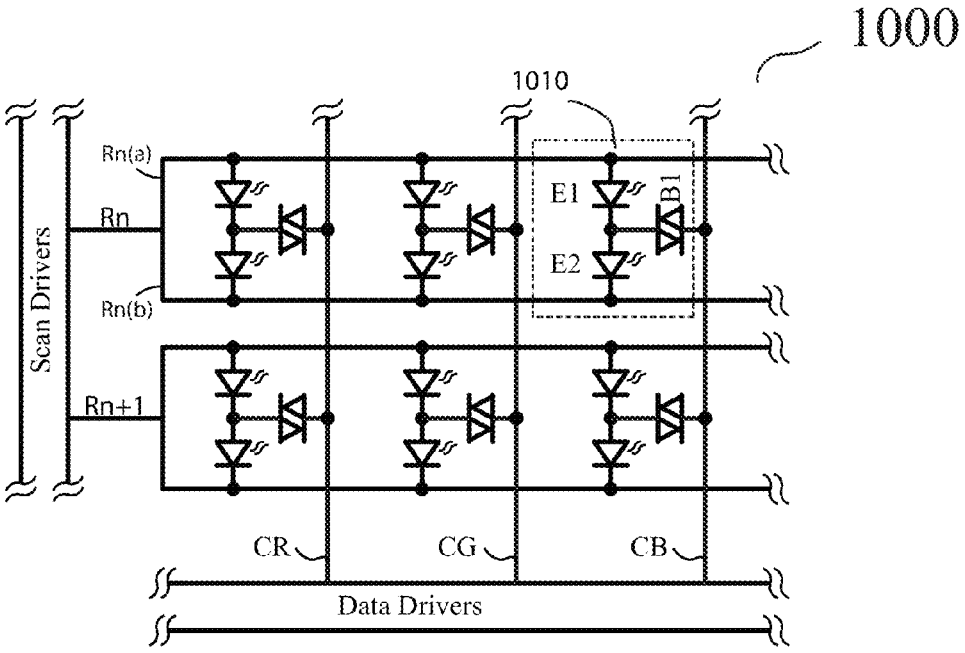
FIG. 10 provides an illustration of a display device with emissive devices coupled to row electrodes and DIACs coupled to column electrodes.

FIG. 10 illustrates a schematic for a display apparatus 1000. Each display cell's AC coupling capacitance is intentionally not shown as it may be disposed at alternate locations as previously described. Specifically, display device 1000 disposes the emissive elements to form the display surface, while disposing the capacitance and DIAC physically beneath, or behind, the emissive element. Display device 1000 comprises scan driver circuits coupled to electrode rows Rn and Rn+1 representing two adjacent rows of display cells. Each display cell 1010 comprises a pair of illumination elements E1 and E2 coupled to row electrode Rn. Illumination elements E1 and E2 are illustrated as light emitting diodes in a series arrangement with a breakover conduction element B1 coupling the common node to a second electrode CB. Column electrode CB is driven by one of a plurality of data drivers for addressing column SB specific cells along each row Rn or Rn+1 during addressing operations. Note that while illumination elements E1 and E2 are illustrated as being series configured, the common row Rn electrode connection disposes them in an opposed parallel configuration, yet serially connected to breakover conduction element B1. Breakover conduction element B1 is bidirectional, with opposing currents flowing through illumination elements E1 and E2 respectively in response to application pulses of opposing direction. Typically, illumination elements E1 and E2 will be the same type of light emitting device, emitting substantially the same color at substantially the same intensity (brightness). It may also be noted that emissive elements may be of differing color to alter the effective color of the cell. In an embodiment of an illumination device, illumination elements E1 and E2 may provide entirely different colors. As an RGB display, column electrodes CR, CG and CB drive adjacent columns of red, green and blue illumination elements, respectively.

Figure 11:
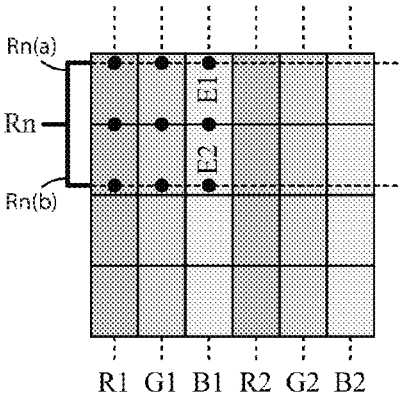
FIG. 11 is a first front (display side) view of a display utilizing structures according to FIG. 10.

FIG. 11 illustrates a front view of display 1000 wherein display cell 1010 is disposed as a blue sub-pixel and comprises illumination elements E1 and E2 for emitting blue light when addressed via column B1. Likewise FIG. 11 illustrates row Rn electrode portions Rn(a) and Rn(b).

Figure 12:
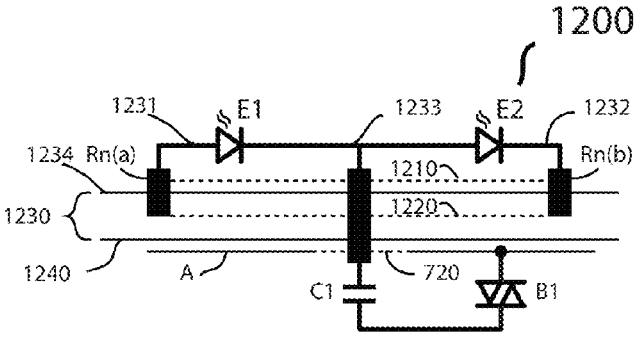
FIG. 12 illustrates a printed circuit embodiment of a display cell according to FIGS. 10 and 11.

FIG. 12 illustrates an embodiment of the invention wherein a display cell 1200 is constructed on a substrate 1230. Substrate 1230 may be fashioned on a multilayer printed circuit board or other suitable substrate material including flexible, ceramic and metallic substrates. Printed circuits are well known in the art, and comprise a stacked assembly of multiple layers; each layer comprising an electrical layer formed on at least one surface of a dielectric substrate. Each electrical layer comprises conductive traces and/or conductive areas for electrically and/or mechanically connecting electronic components. During assembly, the multiple layers are laminated, holes and drilled and plated through to provide interlayer electrical connections. Each electrical layer may be formed on an isolated substrate comprising materials such as a fiberglass, polyimide, ceramic and insulated metal. Metallic and ceramic substrates offer improved thermal conductivity. Usage of metallic substrates is common in the art of LED lighting for transferring LED thermal energy to a heat sinking base assembly. Ceramic substrates are commonly used for discrete devices and cop-packaged devices. Such thermal management practices may be readily applied to embodiments of the invention.

Printed circuit substrate 1230 supports traces 1231, 1232 and 1233 for mounting and coupling illumination elements E1 and E2 to a row electrode Rn and to the memory cell comprising capacitance C1 and breakover conduction device B1. Row electrode Rn may disposed as two parallel traces coupled on at least one end and, optionally and periodically, connected in the vertical direction between display cells by shorting bar 1210 as described in U.S. Pat. No. 6,118,214 to Marcotte; herein incorporated by reference. The use of shorting bars distributes the otherwise unidirectional row currents between electrodes Rn(a) and Rn(b) more evenly for reducing the problem of resistive and inductive effects as described in U.S. patent application Ser. No. 13/218,742 to Marcotte; herein incorporated by reference.

The second surface 1240 of printed circuit 1230 supports the series arrangement of DIAC B1 coupled to capacitor C1 which are then coupled to column electrode Cn. A plated through hole couples capacitor C1 and the emitting elements E1 and E2; illustrated as light emitting devices may be organic light emitting devices (OLEDs) or traditional LEDs. Column electrode A is coupled to a plurality of display cells (not shown) and coupleable to a column driver (not shown). Likewise, and also not shown, row electrode Rn is coupled to a plurality of display cells forming one of a plurality of rows; and coupleable to a row driver.

As illustrated, row electrode Rn is divided into portions Rn(a) and Rn(b) and periodically connected by shorting bar 1210. Alternatively, row electrode Rn may be formed as a continuous planar area 1220 disposed within printed circuit substrate 1230 for reduced resistance and inductance.

Under operation, pulsed voltages are applied to row electrode Rn (i.e. common portions Rn(a) and Rn(b)), column electrode A or both. Operation of display cell 1200 is defined by the voltage applied between row electrode Rn and column electrode A. As a positively sloped voltage is applied between row electrode Rn and column electrode A, DIAC B1 remains non-conductive until the applied voltage, which is AC coupled by capacitor C1, produces a positive voltage across DIAC B1 greater than the positive breakover voltage characteristic of DIAC B1. Once the positive breakover voltage characteristic is exceeded, DIAC B1 transitions from the non-conductive (capacitive) state to the conductive state (negative resistance) wherein a first discharge current flows into display cell 1200 from row electrode Rn(a), serially through illumination element E1, capacitor C1, and DIAC B1 to column electrode A. As current flows, the voltage across DIAC B1 reduces and capacitor C1 is charged according to the applied voltage. As capacitor C1 is charged, the current decreases below the holding current characteristic of DIAC B1 and DIAC B1 will transition back to the non-conductive (capacitive) state.

Reciprocally, as a negatively sloped voltage is applied between row electrode Rn and column electrode A, DIAC B1 remains non-conductive until the applied voltage, which is AC coupled by capacitor C1, produces a negative voltage across DIAC B1 greater than the negative breakover voltage characteristic of DIAC B1. Once the negative breakover voltage characteristic is exceeded, DIAC B1 transitions from the non-conductive (capacitive) state to the conductive state (negative resistance) wherein a second discharge current flows into display cell 1200 from column electrode A, serially through DIAC B1, capacitor C1, and illumination element E1 to row electrode Rn(b). As current flows, the voltage across DIAC B1 reduces and capacitor C1 is charged. As capacitor C1 is charged according to the applied voltage, the current decreases below the holding current characteristic of DIAC B1, and DIAC B1 will transition back to the non-conductive (capacitive) state.

As shown, light emitting diodes E1 and E2 are mounted on a first surface of printed circuit 1230 and capacitor C1 and DIAC B1 are mounted on the second surface. As illustrated in FIG. 11, this mounting configuration enables pluralities of display cells to be arranged in rows and columns of red, green and blue (i.e. electrodes R,G and B) sub-pixels such that only the light emitting components are disposed on the first (i.e. front) face; forming a display surface. Row and column drivers (not shown), are couplable to the row and column electrodes and may likewise be disposed, or attached, on the second (i.e. rear) surface.

Variability in forward voltage or light output illumination elements E1 and E2 and may be controlled by altering the capacitance of capacitor C1 according to respective emissive element pairs. That is, the brightness of red, green and blue subpixels may be controlled by altering the capacitance of respective capacitor C1. Likewise, minor alterations in breakover voltage characteristics within respective DIACs B1 may also be employed.

FIG. 13 illustrates another embodiment of the invention wherein cell capacitance C1 is disposed within a volumetric structure 1330 of display cell 1300. As in FIG. 12, illumination elements E1 and E2 are disposed on a first surface, in an opposed parallel configuration, with a first common point coupled to row electrode Rn according to portions Rn(a) and Rn(b) and, a second common point coupled to a first capacitive plate 1351 of a capacitance C1. A dielectric material 1350 separates the first capacitive plate 1351 from a parallel second capacitive plate 1352. Breakover conduction device B1 is disposed on a second surface and coupled to the second capacitive plate 1352 and to column electrode A. Row electrode Rn may be disposed on the first surface or internal to structure 1310 for coupling display cells disposed in rows. Orthogonally, column electrode A may be disposed on the second surface 1320 for coupling columns of display cells or may be disposed internally.

The embodiment of FIG. 13 operates as previously described with the capacitance C1 storing charge according to the memory state being stored there-across. The capacitive value of capacitance C1 may be controlled by the thickness and dielectric constant of dielectric material 1350 and by the planar area of capacitive plates 1351 and 1352.

As an alternative to using discrete devices for the embodiments of FIGS. 12 and 13, co-packaged elements may be utilized while keeping with the invention.

In another preferred embodiment of the invention, as shown in FIG. 14, a front side, row electrode Rn comprises a metallic portion Rn and a transparent portion 1420 for allowing light to pass through. Metallic and transparent electrodes are well known in the art of display technology and include, but are not limited to, metals such as chrome, copper, silver, gold, aluminum etc. Transparent electrodes include, but are not limited to, tin oxide, indium tin oxide and organic transparent conductive films and polymers. On a back side, vertically oriented column electrodes R, G and B (shown in phantom), may likewise be metallic or transparent. Barriers 1430 and 1440 provide separation between adjacent rows and columns of display cells. Between rows, black stripe BS provides a non-reflective surface for contrast enhancement. Volumetrically, display cells contain one or more dielectric layers, illumination elements E1 and E2 and at least one breakover conduction device (not shown).

FIGS. 15*a* and 15*b* illustrate cross sectional views of an illumination device detailing the portions that occupy the volumetric space between opposing terminals. Terminals may be coupled to electrodes of a display device, or may be terminals of a discrete electronic component supported by a suitable substrate such as a ceramic. Terminal portions T1 and T2 provide connection points for opposing electrodes. The placement of the device's dielectric layer 1520 and/or 1540 may be disposed over terminal T1, T2 or both respectively. For illumination through terminal T1, terminal T1 comprises metallic electrode 1505 and transparent electrode 1510. The light emitting portion comprises opposed parallel LEDs E1 and E1 for conducting opposing breakover conduction currents as indicated by arrows 1521 and 1522.

As illustrated, the breakover conduction portion B1 is illustrated as a commonly used semiconductor layers for DIACs. Optional terminals 1530 and 1540 provide for electrically coupling the DIAC B1 to other portions of the device. DIAC B1 comprises alternating P-type and N-type semiconductor materials which form a breakover conduction switch. Specifically, for a conduction through LED E1, a positive voltage is applied across terminal T1 relative to terminal T2. The junction between N layer 1533 and P layer 1534 withstands voltage up to the breakdown rating of the junction, and thus the breakover voltage. As the breakdown voltage of this junction is exceeded, DIAC B1 enters breakover conduction with layers N 1533, P 1534 and N 1535 forming a saturated NPN transistor coupled to terminal T2 as current 1521 flows there-through. The doping of the P-type layers determines the breakover voltage and the bidirectional holding current symmetry. When conducting breakover conduction current 1521 through DIAC B1, current also flows, in series, through LED E1. When conducting the opposing current 1522, DIAC B1 forms a second saturated NPN transistor comprising layers 1531, 1532, 1533 coupled to LED E2. In either case, the alternate P-type layer provides holes to enable the current flow. As the current there-through declines the number of holes declines and switches the device off, thus defining the holding current characteristic.

Under operation, a positive terminal T1 yields a breakover current flow through LED E1 and through DIAC B1 while charging a dielectric barrier disposed either as layer 1520, 1540 or both, as previously described. Conversely, a positive terminal T2 yields the opposed breakover current flow through DIAC B1 and through LED E2, oppositely charging the dielectric barrier disposed either as layer 1520, 1540 or both. As is well known in the art, LEDs emit light at the PN junction boundary; hence the lateral PN junction configuration.

While LEDs and DIACs share some fabrication processes, chemistries and other process specific variations may be employed while keeping with the invention. Thus a discrete device may comprise a capacitively coupled breakover device co-packaged with one or more LED devices, or each element may be co-packaged into a single device.

In another alternative embodiment, ultra-violet emitting LEDs may be employed with a phosphor layer deposited on an interior surface; for example a lens covering and or encapsulating the device.

FIG. 15*b* depicts the structure of another embodiment of the illumination device shown in FIG. 15*a* using an exemplary organic layer stack configuration for opposing illumination elements. Specifically, illumination element E1 comprises a hole injection layer, an emissive layer, and an electron injection layer. Conversely, illumination element E2 comprises an electron injection layer, emissive layer, and a hole injection layer. As current flows through either element, holes and electrons combine in the emissive layer and emit wavelengths of light corresponding to the material of the emissive layer. The organic layers are top emitting, thus offering a small cell size.

Figure 16:
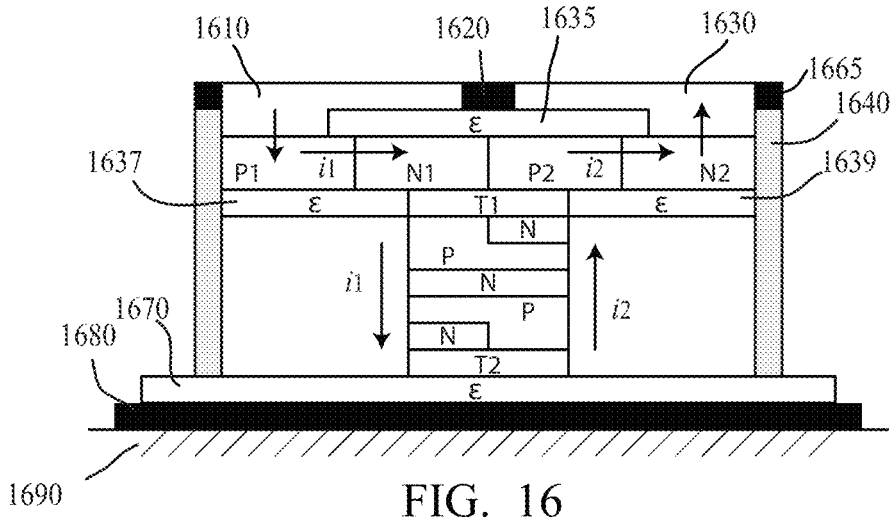
FIG. 16 illustrates a cross-sectional view of an integrated illumination device structure.

FIG. 16 illustrates a cross-section of display cell utilizing an illumination device employing an AC-coupled DIAC corresponding to the topology of FIG. 15*a*. Display cell 1600 comprises a metallic electrode 1620 coupled to transparent electrodes 1610 and 1630. Barriers 1640 isolate adjacent display cells and optional black stripe 1665 provides contrast enhancement. A first light emitting diode (LED) comprises semiconductor junction P1-N1. A second LED comprises semiconductor P2-N2. Dielectric regions 1635, 1637 and 1639 provide isolation regions such that breakover conduction currents i1 and i2 flow through the LEDs as indicated, with dielectric region 1635 being optically transparent for allowing light to pass through. Dielectric regions 1637 and 1639 may be reflective to redirect light toward transparent electrode 1610 and 1630, respectively. Optional terminal layers T1 and T2 couple the DIAC there-between to the LEDs via terminal T1 and to an orthogonal electrode 1680 via terminal T2 capacitively coupled by dielectric barrier 1670. Optional terminal layers T1 and T2 provide for electrical compatibility between LED regions N1 and P2 and dielectric layer 1670, respectively. Lastly, a substrate 1690 supports the AC-coupled light emitting breakover conduction illumination cell. Substrate 1690 may comprise one of: silicon, glass, an insulated metal, fiberglass, polyimide, or other suitable material.

Figure 17:
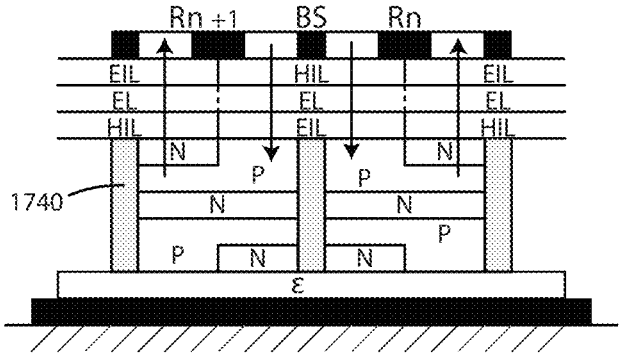
FIG. 17 illustrates a cross-sectional view of illumination devices with organic light emitting materials disposed over capacitively coupled DIACs.

FIG. 17 provides another exemplary display embodiment of the invention utilizing organic light emitting materials within adjacent, and complimentary, illumination device structures sharing organic layers. The cross-sectional view of FIG. 17 illustrates two vertically adjacent rows Rn and Rn+1 for emitting the same color light wherein the organic material layers span across the barrier divider 1740 and are disposed atop a DIAC breakover conduction device. As in FIG. 16, a top layer comprises metallic and transparent electrodes coupled to a row Rn and Rn+1 and optionally a non-conductive black stripe there-between. The emissive region of each display cell comprises opposing organic electron injection layers, a common emission layer and opposing hole injection layers. As shown, and preferred, hole injection and electron injection layers span adjacent rows for improved manufacturability. Each layer may be continuous or divided along the cell or barrier centerlines as appropriate. Each adjacent DIAC has an opposed layer stack, such that an N-type semi-conductive region is coupled to the hole injection layer and the P-type semi-conductive region is coupled to the electron injection layer for electron/hole compatibility.

Thus, embodiments of the invention herein described may be utilized to realize illumination devices, and full color displays ranging from small tightly integrated displays to large area displays having uniformly controlled currents providing uniformly controlled brightness.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A device comprising:

a. a substrate supporting a first electrode;

b. a dielectric material covering said first electrode;

c. a first breakover conduction device comprising a first terminal capacitively coupled to said first electrode according to said dielectric material;

d. first and second light emitting areas disposed in an electrically opposed parallel arrangement comprising a first terminal coupled to a second terminal of said breakover conduction element;

e. a second electrode coupled to a second terminal of said first and second light emitting areas.

2. The device of claim 1, further comprising; a driving circuit, coupleable to at least one of said first and second electrodes wherein said driving circuit applies illumination pulses.

3. The device of claim 2, said driving circuit further comprising: a row driver coupled to said second electrode; a column driver coupled to said first electrode; a pulse generator coupled to said row drivers; wherein said pulse generator applies said illumination pulses, said row driver applies a row selection pulse, and said column driver applies a data pulse according to display data.

4. The device of claim 1, wherein said second terminal of said first breakover conduction device has a first and second nodes coupled to first and second light emitting areas.

5. The device of claim 1, wherein adjacent cells share at least a portion of said first and second light emitting areas.

6. The device of claim 5, further comprising a barrier said adjacent cells.

7. The device of claim 1, wherein said second electrode comprises a metallic portion and a transparent portion.

8. The device of claim 1, wherein said light emitting areas comprise at least one of: a light emitting diode and organic light emitting materials.

9. The device of claim 1, wherein said breakover conduction device is a DIAC.

10. A method for driving a solid-state breakover conduction display comprising; applying a first pulse of a first voltage for initializing all cells in said display, setting a memory state in a cell disposed at the intersection of a row electrode and a column electrode according to a display data respective of a display image, said setting comprising the steps of applying a row select voltage to select said row electrode for addressing, applying a column select voltage, to select said column electrode for addressing and for triggering a first address discharge and of removing said row select voltage and said column select voltage for triggering a second address discharge, opposite to said first discharge.

11. The method of claim 10, wherein said applying a first pulse comprises applying, over time, said first voltage wherein an initialization discharge in said cell comprises a first cell discharge current less than a holding current characteristic of said cell.

12. The method of claim 11 further comprising, applying a plurality of driving pulses of a second voltage for triggering opposing discharges for emitting visible light according to said opposing discharges.

13. The method of claim 11 further comprising, applying a third voltage, over time, wherein an erasing discharge comprises a second cell discharge current less than said holding current characteristic of said cell.

14. The method of claim 13 wherein said third voltage is substantially equal to said second voltage.

15. A device comprising an illumination element comprising first and second terminals for applying first and second voltages there-across and for conducting respective first and second opposing currents there-through coupling, in a serial arrangement:

a. a light emission portion disposed on a first surface for emitting light according to said first and second opposing currents;

b. a breakover conduction portion disposed on a second surface for drawing said first and second opposing currents according to third and fourth voltages; and, c. a dielectric barrier forming a capacitance for limiting said first and second opposing currents.

16. The device of claim 15, said substrate further comprising first and second conductive layers and a dielectric there between for forming said capacitance.

17. The device of claim 15, said capacitance disposed on said second surface.

18. The device of claim 15, said substrate comprising a first electrode coupled to respective first terminals of a first plurality of said illuminations cells and orthogonally, a second electrode coupled to respective second terminals of a second plurality of said illuminations cells.

19. The device of claim 18 said first electrode comprising first and second trace portions and at least one of; a plurality of shorting bars connecting said first and second trace portions, and a conductive plane within said first substrate.

20. The device of claim 15, said light emission element comprising first and second light emitting portions for conducting said first and second opposing currents respectively wherein said light emission element comprises at least one of: a light emitting diode and an organic light emitting device.

21. The device of claim 20 said organic light emitting device comprising a hole injection layer, an emissive layer, and an electron injection layer and wherein said light emission portions comprise opposing arrangements of said hole injection and said electron injection layers.

22. The device of claim 21 wherein adjacent illumination cells emit light of substantially the same color in a first direction and dis-similar light in a second direction and wherein said adjacent illumination cells in said first direction wherein said emissive layer is undivided in said first direction.

* * * * *